US005581624A

United States Patent [19]

Geisenberger et al.

[11] Patent Number: 5,581,624

[45] Date of Patent: Dec. 3, 1996

[54] LOUDSPEAKER SUITABLE FOR HIGH-TEMPERATURE USE HAVING A NON-ADHESIVE CONNECTION BETWEEN THE VOICE COIL SUPPORT AND THE LOUDSPEAKER DIAPHRAGM

[75] Inventors: Stefan Geisenberger, Straubing; Manfred Aigner, Schwarzach, both of Germany

[73] Assignee: Nokia Technology GmbH, Pforzheim, Germany

[21] Appl. No.: 447,972

[22] Filed: May 23, 1995

[30] Foreign Application Priority Data

Jun. 1, 1994 [DE] Germany ..... 44 19 249.5

[51] Int. Cl.[6] ..... H04R 25/00

[52] U.S. Cl. ..... 381/204; 381/202

[58] Field of Search ..... 381/202, 194, 381/195, 196, 197, 198, 199, 204, 205, 201; 285/381; 403/273, 29, 34; 181/171

[56] References Cited

U.S. PATENT DOCUMENTS

| | | | |
|---|---|---|---|
| 2,234,833 | 3/1941 | Preston | 381/193 |
| 4,577,069 | 3/1986 | Keezer | 381/201 |
| 5,340,167 | 8/1994 | Morse | 285/273 |

FOREIGN PATENT DOCUMENTS

| | | | |
|---|---|---|---|
| 0270981 | 6/1988 | European Pat. Off. . | |
| 3321278 | 12/1983 | Germany . | |
| 3917477 | 12/1990 | Germany . | |
| 0016797 | 1/1985 | Japan | 381/193 |
| 0005699 | 1/1986 | Japan | 381/199 |
| 0215200 | 8/1989 | Japan | 381/199 |
| 522555 | 7/1976 | U.S.S.R. . | |

*Primary Examiner*—Sinh Tran

*Attorney, Agent, or Firm*—Ware, Fressola, Van Der Sluys & Adolphson

[57] ABSTRACT

In the state of the art, most loudspeaker diaphragms 10 and the voice coil supports 11 are joined by adhesives. However, even high-grade adhesives fail if such loudspeakers are subjected to continuous operating temperatures much above 120 degrees Celsius. The one-piece construction of loudspeaker diaphragm 10 and voice coil support 11 is also limited. It is particularly difficult to produce one-piece metal constructions by means of the deep-draw process. It is therefore the task of the invention to present a joint of loudspeaker diaphragm 10 and voice coil support 11, which is simple to produce, can be subjected to high temperatures and is free of adhesives. This task is fulfilled in that the upper rim 19 of the voice coil support 11 is flared together with the upper rim 16 of a neck 12 formed on the diaphragm 10. In addition the invention proposes to join the neck 12 of loudspeaker diaphragm 10 to the voice coil support 11 through the effect of a ring-shaped part 23. If the neck 12 of diaphragm 10 is located between the ring-shaped part 23 and the voice coil support 11, the latter has the function of opposing the pressure (force) exerted by the ring-shaped part 23 on the outside jacket of the neck 12.

5 Claims, 3 Drawing Sheets

LOUDSPEAKER SUITABLE FOR HIGH-TEMPERATURE USE HAVING A NON-ADHESIVE CONNECTION BETWEEN THE VOICE COIL SUPPORT AND THE LOUDSPEAKER DIAPHRAGM

TECHNICAL FIELD

The invention concerns the connection of a loudspeaker diaphragm to a voice coil support.

BACKGROUND OF THE INVENTION

In the state of the art, the loudspeaker diaphragm is generally attached to the tube-shaped voice coil support with an adhesive. This technique was proven in loudspeakers subjected to a temperature of about 120 degrees Celsius. However, the above named adhesive bonds can no longer be used if loudspeakers must operate reliably at higher than the indicated operating temperatures. Even the use of adhesives that are resistant at higher temperatures is not enough to solve this problem of the mechanically highly stressed joints of voice coil support and loudspeaker diaphragm, since these adhesives are not suited for use above 200 degrees Celsius. Furthermore, the use of such improved, but sometimes also toxic, adhesives can presently no longer be justified for environmental protection reasons.

Although one-piece construction of a loudspeaker diaphragm and a voice coil support are known, they can only be made of plastic or paper/cardboard because of the weight ratios required for this combination. One-piece constructions of light metal, which are accessible to higher operating temperatures as compared to plastic or paper constructions, are presently not available. Tests made by the applicant, to form one-piece aluminum construction of a loudspeaker diaphragm and a voice coil support, have shown that in deep-draw processes, the neck (which serves as voice coil support) with a wall thickness of about 200 μm as required for the diaphragm cone, can only be manufactured to a length of about 10 mm. But such neck lengths are not suitable as voice coil supports. In addition, the 200 μm wall thicknesses of the voice coil supports result in wide air gaps. This lowers the air gap induction and has a negative effect on the temperature stability of the magnet system.

SUMMARY OF THE INVENTION

It is therefore the task of the invention to present a connection of loudspeaker diaphragm and voice coil support that is simple to manufacture and can withstand temperatures to above 400 degrees Celsius.

A common principle of the present invention is to exclude the use of adhesives to join a voice coil support and a loudspeaker diaphragm, and instead to join both named loudspeaker components by purely mechanical means.

The loudspeaker diaphragm can be fabricated from metal and provided with a neck that extends into the space formed by the conical diaphragm, with the joint of neck and the upper rim of the voice coil support formed as a curled joint. This curled or flared joint permits manufacture of the loudspeaker diaphragm and the neck as a deep-drawn part, since the necks produced by the deep-draw process are long enough to create a curled joint between the voice coil support and the neck of the loudspeaker diaphragm.

If the transition area between loudspeaker diaphragm and neck is in the form of a radius, breakage of the neck during the deep-draw process need not to be feared.

The production of the curled or flared joint is further simplified if the upper rims of the voice coil support and neck are provided with notches running in the direction of the loudspeaker axis.

Another mechanical, i.e. adhesive-free joint between voice coil support and loudspeaker diaphragm is created, if the neck of the loudspeaker diaphragm and the voice coil support telescope into each other, so that the two parts overlap, and if a ring-shaped (joint) area is available, which presses the neck of the loudspeaker diaphragm against the wall of the voice coil support, or presses the wall of the voice coil support against the neck of the loudspeaker diaphragm. If the neck of the loudspeaker diaphragm is located between the outside jacket of the voice coil support and the inner sleeve of the ring-shaped part, the required pressure effect can be achieved by heat-shrinking the ring-shaped part.

It is particularly advantageous if the ring-shaped part and the voice coil support or the neck of the loudspeaker diaphragm have different coefficients of thermal expansion. In that event, the different expansion of ring-shaped part and voice coil support or loudspeaker diaphragm neck can be used to further increase the pressure on the joined parts at higher operating temperatures.

If the wall thickness of voice coil support or loudspeaker diaphragm should not have sufficient stability to withstand the pressure exerted by the ring-shaped part, it is advantageous to provide a reinforcing ring on the side of the loudspeaker diaphragm or the voice coil support that faces away from the ring-shaped part.

The pressure between the ring-shaped part and the reinforcing ring can be increased with rising operating temperature, if the thermal expansion coefficients of ring-shaped part and reinforcing ring are different.

It should be pointed out that the pressure of the ring-shaped part can also be used to join the centering diaphragm of the loudspeaker to the voice coil support or the loudspeaker diaphragm.

BEST MODE FOR CARRYING OUT THE INVENTION

The invention will now be explained in more detail by means of the figures.

Figure 1:
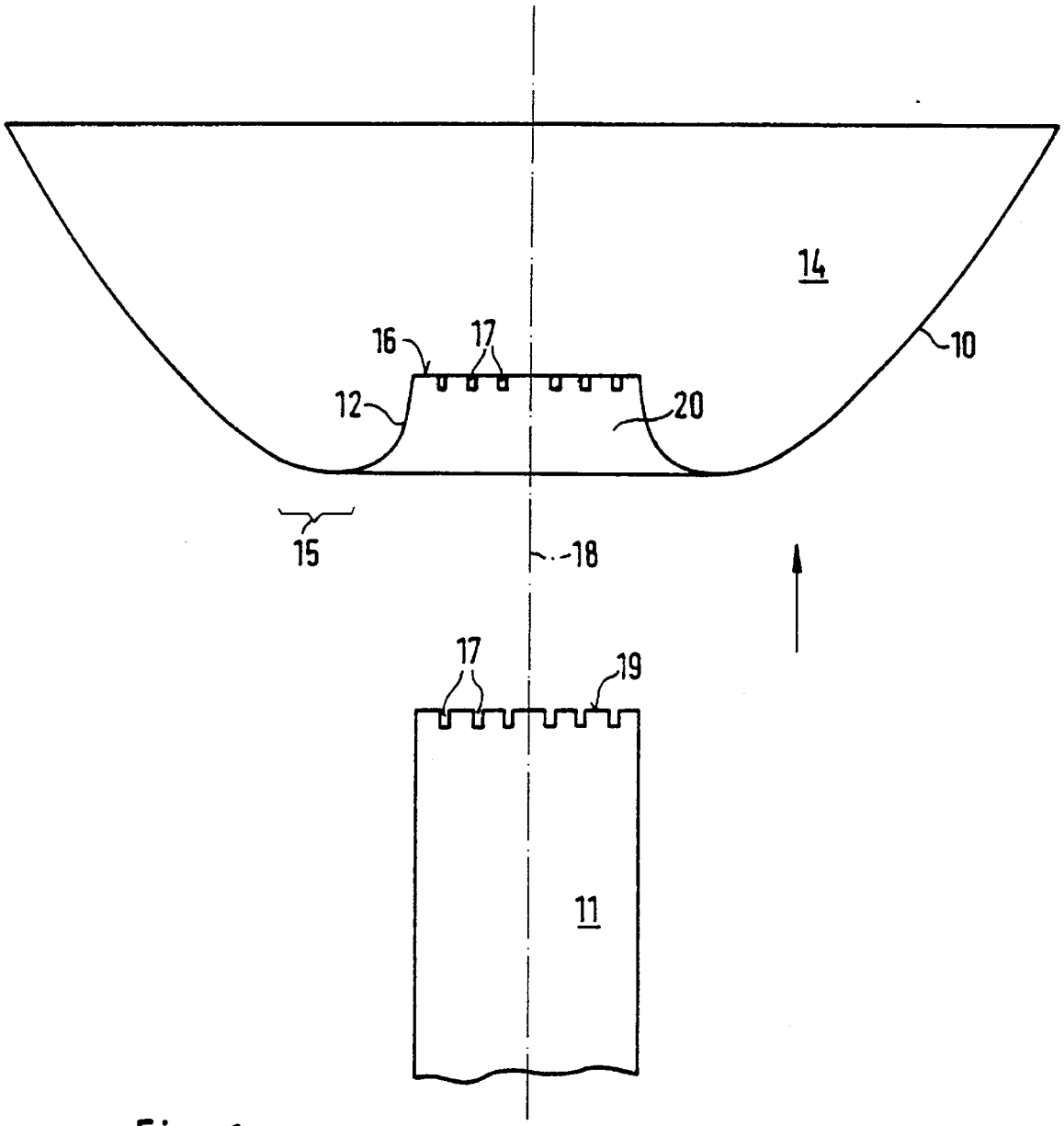
FIG. 1 is a cut through the loudspeaker diaphragm and the voice coil support.

The top part of the schematic cross sectional illustration of FIG. 1 depicts a loudspeaker diaphragm 10 and the bottom part a voice coil support 11. In this configuration example, both parts 10, 11 are made of aluminum. This does not mean that the loudspeaker diaphragm 10, the voice coil support 11 or even both parts 10, 11 cannot be made of a different metal.

The approximately conical loudspeaker diaphragm 10 is provided with a formed neck 12. This neck 12 extends into the space 14, which is limited by the inner sleeve of the conical diaphragm 10. The transition area 15 of loudspeaker diaphragm 10 and neck 12 has a rounded shape. The upper rim 16 of neck 12 is equipped with notches 17, to simplify the curling process described later in more detail. These notches 17 run parallel to the loudspeaker axis 18.

The voice coil support 11 is tube-shaped and also has notches 17 in its upper rim 19, which run parallel to the loudspeaker axis 18. These notches 17 in the upper rim 19 of voice coil support 11 also serve to improve the curling process that will be described later.

To form a unit of loudspeaker diaphragm 10 and voice coil support 11, the voice coil support 11 is inserted, for example in the direction of the arrow, into the neck opening 20 of loudspeaker diaphragm 10.

Figure 2A:
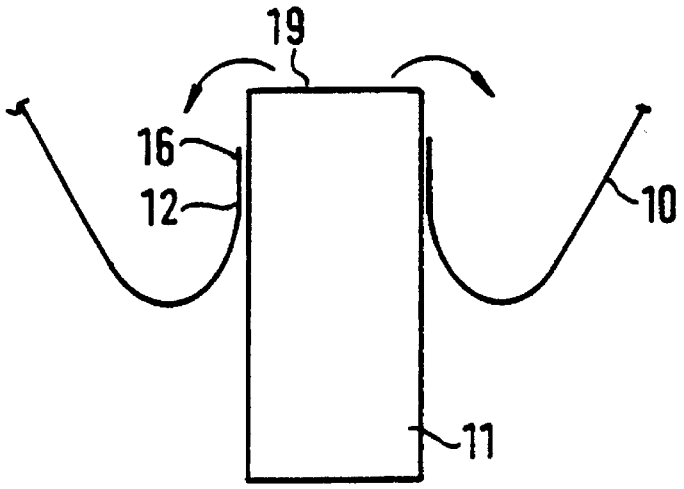
FIG. 2*a–c* is another illustration of FIG. 1 in three production stages.

This condition is schematically illustrated in FIG. 2*a*. It can clearly be seen in this illustration that, once the voice coil support 11 has reached its final position in the neck opening 20, the upper rim 19 of voice coil support 11 extends beyond the upper rim 16 of neck 12. It should be pointed out in this connection that the notches of FIG. 1 have been omitted in the illustrations of FIGS. 2*a* to *c*.

To join the loudspeaker diaphragm 10 to the voice coil support 11, the upper rim 16 of the voice coil support 11 is bent outward around the upper rim 19 of the neck 12 (shown by the curved arrows in FIG. 2*a*).

Figure 2B:
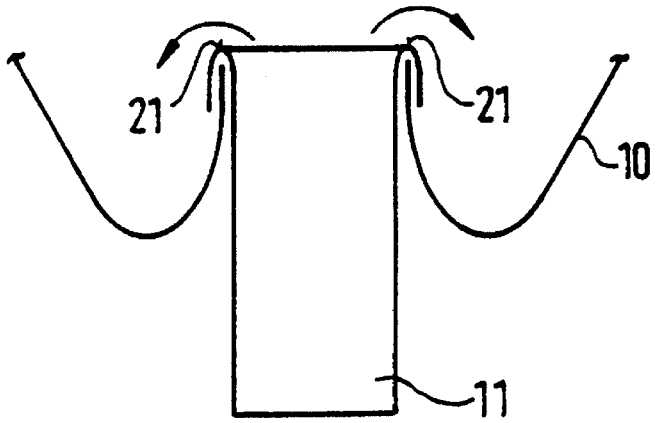

Once this curling process has been completed, the voice coil support-loudspeaker diaphragm combination looks as shown in FIG. 2*b*. To make the first curl explained in conjunction with FIG. 2*a* visible, the narrow joint between rims 16, 19 was not shown in the illustration of FIG. 2*b*.

Once the condition according to FIG. 2*b* is achieved, the upper rim 21 formed by the first curl is again bent outward (indicated by the arrows in FIG. 2*b*).

Figure 2C:
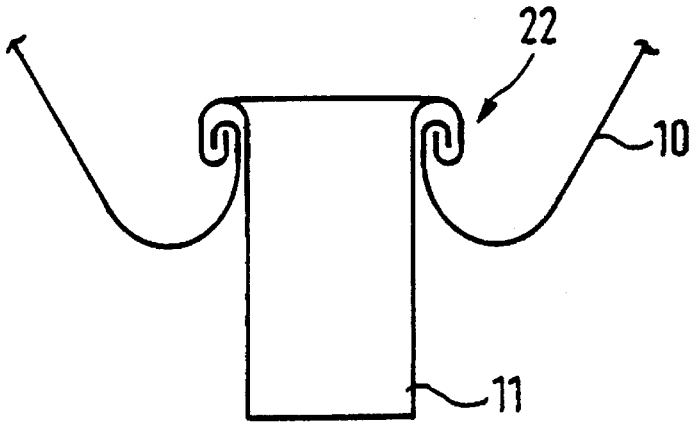

After the second curling is completed, a condition as shown in FIG. 2*c* occurs. The curled joint 22 securely connects the coil support 11 and the loudspeaker diaphragm 10 to each other, since after the second curling the bent rim areas are superimposed on each other without any separation. The latter is not illustrated in FIG. 2*c* to better clarify the curling process.

If the static friction of the folded joint 22, shown in FIG. 2*c*, between the two contacting parts of neck 12 and voice coil support 11 is to be increased with rising operating temperatures, the part that is only curled once (like the neck 12 in FIGS. 2*a* to *c*), should have a higher coefficient of thermal expansion than the part that is curled several times (in this case the upper rim of the voice coil support 11).

The notches 17 in the upper rim 16 of the neck 12 and the upper rim 19 of the voice coil support 11 facilitate bending over the upper rims 16, 19 as described to thereby simplify and improve the first and second curling processes.

FIGS. 3*a–g* refer to the joint between loudspeaker diaphragm 10 and voice coil support 11 of an alternative embodiment of the present invention. As shown by schematic illustrations in FIGS. 3*a, c, e* and *g*, the tube-shaped voice coil support 11 is inserted into an opening enclosed by the neck 12 of loudspeaker diaphragm 10, and extends into the space 14 formed by the inner sleeve of the conical diaphragm surface. The fact that the neck 12 of loudspeaker diaphragm 10 extends downward in FIGS. 3*a–g*, in contrast to the illustrations of FIGS. 1 and 2, is only significant for the configuration of the invention in FIGS. 3*b, d* and *f*, since the configuration of the invention according to FIGS. 3*a, c, e* and *g* is also given when the neck 12 of diaphragm 10 extends into the space 14. It should be pointed out for the latter, which is not a separately illustrated configuration, that in addition to the ring-shaped part 23 which produces the joint, the upper rims of neck 12 and voice coil support 11 can be curled as depicted in conjunction with FIGS. 1 and 2.

Figure 3A:
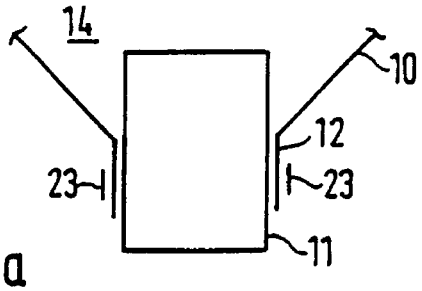
FIG. 3*a–f* are seven further illustrations of FIG. 2*c*.
Figure 3B:
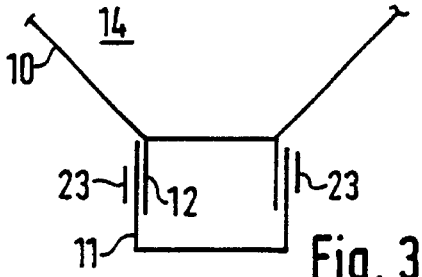

According to the illustrations of FIGS. 3*b, d* and *f*, the neck 12 of loudspeaker diaphragm 10 is inserted into the tube-shaped voice coil support 11.

In the illustration of FIG. 3*a*, the outside jacket of neck 12 is surrounded by a ring-shaped part 23, which presses the neck 12 against the wall of voice coil support 11. For reasons of better visibility, the superimposition of the respective parts in the joint area of FIGS. 3*a–g* was omitted.

To achieve the required pressure effect from the ring-shaped part 23 depicted in FIG. 3*a*, this part 23 was heat-shrunk over the neck 12. To improve the pressure effect, the ring-shaped part 23 has a lower coefficient of thermal expansion than the voice coil support 11. This has the effect that with rising operating temperature, the ring-shaped part 23 exerts greater pressure force on the neck 12 and the voice coil support it. To further improve the joint of voice coil support 11 and loudspeaker diaphragm 10, the areas of these components that come in contact with each other may be roughened on the sides facing each other.

In the illustration of FIG. 3*b*, the ring-shaped part 23 is located on the outside jacket of voice coil support 12. In this illustration, the neck 12 of loudspeaker diaphragm 10 serves to oppose the pressure force exerted by the ring-shaped part 23. For that reason, the illustration of FIG. 3*b* depicts the loudspeaker diaphragm 10 and therefore also the neck 12 to be made of metal. The voice coil support 11 is clamped between the outside jacket of neck 12 and the ring-shaped part 23. In the illustration according to FIG. 3*b*, the ring-shaped part 23 was heat-shrunk as well. To improve the pressure effect of the ring-shaped part 23 during operation of the loudspeaker, in this illustration as well, the ring-shaped part 23 has a lower coefficient of thermal expansion than the neck 12.

Figure 3C:
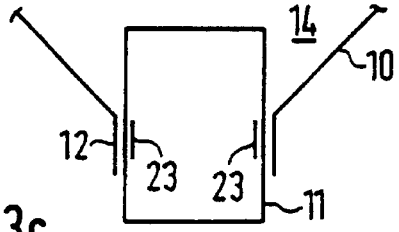
Figure 3D:
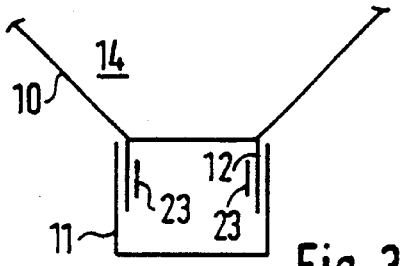

According to the illustrations in FIGS. 3*c* and *d*, the ring-shaped part 23 is located inside the voice coil support 11 (FIG. 3*c*), or inside the neck 12 (FIG. 3*d*). In order for the ring-shaped part 23 to exert sufficient pressure force on the parts 12 or 11 that oppose it, the ring-shaped part 23 was inserted in a supercooled condition. If the ring-shaped part 23 is to exert a greater pressure force on the respective opposing parts with rising operating temperature according to FIGS. 3*c* and *d*, the ring-shaped part 23 must have a higher coefficient of thermal expansion than the respective opposing parts.

Figure 3E:
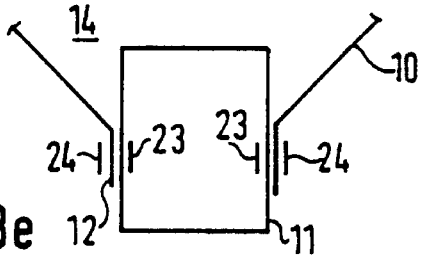
Figure 3F:
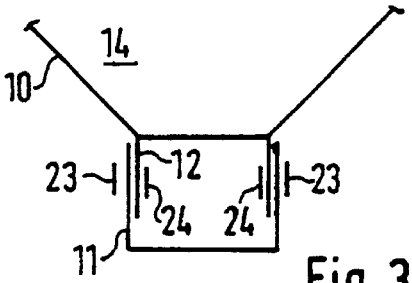

The illustration in FIG. 3*e* and *f* has a reinforcing ring 24 in addition to the ring-shaped part 23, which is located on the side of the neck 12 or the voice coil support 11 that faces away from the ring-shaped part 23. The use of the reinforcing ring 24 is necessary, if the neck 12 or the voice coil support 11 does not have sufficient stability by itself to oppose the pressure force exerted by the ring-shaped part 23. Whether the ring-shaped part 23 is located outside or inside, and the reinforcing ring 24 inside or outside of the loudspeaker diaphragm-voice coil support combination, is left to the will of the technician. It is only important for the respective inside part to have a higher coefficient of thermal expansion than the respective outside part.

Figure 3G:
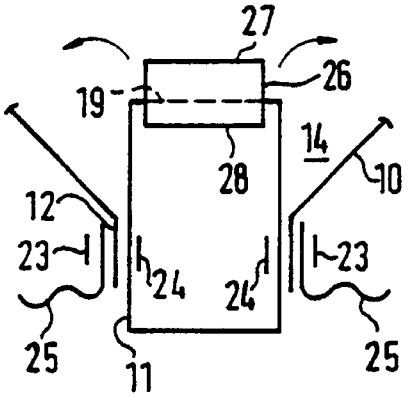

In addition to the neck 12 of loudspeaker diaphragm 10 and the voice coil support 11, FIG. 3*g* also depicts a centering loudspeaker diaphragm 25 between the ring-shaped part 23 and the reinforcing ring 24.

FIG. 3*g* furthermore contains a dust protection cap 26, which is partially inserted into the inner cross section of the ring-shaped voice coil support 11. This cap 26 is connected to the voice coil support 11 in the manner shown in FIGS. 2*a–c*, wherein the upper rim 27 is bent in the arrow direction. As already explained in conjunction with FIGS. 1 and 2*a–2c*, the rims 19, 27 may contain notches along the loudspeaker axis (not illustrated), to simplify the curling process. If the curled joint is located between the cap 26 and the voice coil support 11, the bottom 28 of cap 16 seals the inside cross section of the voice coil support 11, thus preventing dust from entering into the air gap of the magnet system. The fact that the outside jacket of the cap 26 in FIG. 3*c* is not located against the inside sleeve of the voice coil support 11, is only for reasons of better visibility.

What is claimed is:

1. An improved loudspeaker with a cone-shaped loudspeaker diaphragm (10) and a metal voice coil support (11) with a rim (19) joined to the loudspeaker diaphragm (10) in a circular joint, wherein the improvement is that the loudspeaker diaphragm (10) is made of metal and has a neck (12) also having a rim (16) which extends into a space (14) formed by the cone-shaped loudspeaker diaphragm (10), wherein the rim (16) of the neck (12) of the loudspeaker diaphragm (10) and the rim (19) of the voice coil support (11) are curled rims mated in a mechanical circular joint (22), and wherein the circular joint is free of adhesive and is usable at high temperatures, and wherein the rims (16, 19) of the voice coil support and the neck of the loudspeaker diaphragm have notches (17) to facilitate bending over of the rims into said curled rims mated in the mechanical circular joint (22).

2. The improved loudspeaker as in claim 1, wherein a transition area of the loudspeaker diaphragm (10) and the neck (12) is rounded.

3. A loudspeaker, comprising:

a cone-shaped loudspeaker diaphragm (10) which contains a formed neck; and a voice coil support (11) made of metal with an upper rim (19) joined to the neck (12) of the loudspeaker diaphragm (10);

wherein a ring-shaped part (23) is provided in a joint area of the loudspeaker diaphragm (10) and the voice coil support (11), which presses the voice coil support (11) and the loudspeaker diaphragm (10) against each other for forming an adhesive-free joint that is usable at high temperatures; and wherein a reinforcing ring (24) is provided, which is located on the side of the voice coil support (11) and the loudspeaker diaphragm (10) that faces away from the ring-shaped part (23).

4. A loudspeaker as in claim 3, wherein the ring-shaped part (23), and at least the voice coil support (11) or the loudspeaker diaphragm have different coefficients of thermal expansion.

5. A loudspeaker as in claim 3, wherein the ring-shaped part (23) and the reinforcing ring (24) have different coefficients of thermal expansion.

* * * * *